US006181196B1

(12) United States Patent
Nguyen

(10) Patent No.: US 6,181,196 B1
(45) Date of Patent: Jan. 30, 2001

(54) ACCURATE BANDGAP CIRCUIT FOR A CMOS PROCESS WITHOUT NPN DEVICES

(75) Inventor: Baoson Nguyen, Plano, TX (US)

(73) Assignee: Texas Instruments Incorporated, Dallas, TX (US)

( * ) Notice: Under 35 U.S.C. 154(b), the term of this patent shall be extended for 0 days.

(21) Appl. No.: 09/211,400

(22) Filed: Dec. 14, 1998

Related U.S. Application Data

(60) Provisional application No. 60/068,087, filed on Dec. 18, 1997.

(51) Int. Cl.[7] ..... G05F 1/10
(52) U.S. Cl. ..... 327/539; 327/540
(58) Field of Search ..... 327/539, 540, 327/565; 323/313

(56) References Cited

U.S. PATENT DOCUMENTS

| | | | | |
|---|---|---|---|---|
| 4,317,054 | * | 2/1982 | Caruso et al. | 327/539 |
| 4,447,784 | * | 5/1984 | Dobkin | 323/313 |
| 5,087,830 | * | 2/1992 | Cave et al. | 327/539 |
| 5,471,131 | * | 11/1995 | King et al. | 323/539 |
| 5,619,163 | * | 4/1997 | Koo | 327/539 |
| 5,900,773 | * | 5/1999 | Susak | 327/539 |

OTHER PUBLICATIONS

Article, E. Holle, A CMOS Bandgap Reference with Reduced Offset Sensitivity, presented at Fourteenth European Solid–State Circuits Conference Sep. 21–23, 1988, pp. 206–210.

Article, Mark Pedersen, Peter Metz, A CMOS to 100K ECL Interface Circuit, 1989 IEEE International Solid State Circuits Conference, pp. 226–227.

* cited by examiner

*Primary Examiner*—Terry D. Cunningham
(74) *Attorney, Agent, or Firm*—Dwight N. Holmbo; Wade James Brady, III; Frederick J. Telecky, Jr.

(57) ABSTRACT

An integrated circuit (12) made with a CMOS P-epi process includes a bandgap circuit (16). A pair of PNP bipolar junction transistors (73, 72) have respective currents flowing through them with a ratio of 8 to 1. A differential stage has a further pair of PNP bipolar junction transistors (66, 67) which are identical, and which have their emitters coupled to each other and to a power source (11). Each transistor of the further pair has a base coupled to the emitter of a respective transistor of the first pair. The output of the differential stage controls a current source (82), which causes a current to flow through multiple resistors (86, 87, 88) and through a diode (30). One of the resistors (87) has its ends coupled to the respective bases of the transistors of the first pair.

15 Claims, 1 Drawing Sheet

ACCURATE BANDGAP CIRCUIT FOR A CMOS PROCESS WITHOUT NPN DEVICES

This application claims priority under 35 USC § 119(e) (1) of provisional application No. 60/068,087 filed Dec. 18, 1997.

TECHNICAL FIELD OF THE INVENTION

This invention relates in general to a bandgap circuit and, more particularly, to a simple and accurate bandgap circuit suitable for implementation in an integrated circuit made by a CMOS P-epi process.

BACKGROUND OF THE INVENTION

Bandgap circuits are widely used for the purpose of generating an accurate reference voltage which does not vary with temperature. In a context where PNP and NPN bipolar transistors are readily available, there are known bandgap circuits which are relatively simple and accurate. In the context of an integrated circuit made by a CMOS P-epi process, PNP-type bipolar junction transistors can be fabricated in a manner compatible with the CMOS process and without undue additional expense. However, NPN-type bipolar junction transistors can only be fabricated in a CMOS P-epi process by carrying out extra process steps that add significantly to the complexity and cost of the overall process.

For many applications, cost is a critical factor, and the additional complexity and cost involved with fabricating NPN-type bipolar junction transistors cannot be justified. Therefore, as a practical matter, only field effect transistors and PNP-type bipolar junction transistors are available. A consequence is that bandgap circuits in an integrated circuit made by a CMOS P-epi process are more complex and less accurate than they would be if NPN-type bipolar transistors were readily available.

As to accuracy, bandgap circuits in a CMOS process typically include a pair of bipolar junction transistors or diodes, and an operational amplifier having a differential input stage made with CMOS transistors. The operational amplifier has an output stage with a gain of about ten. The diodes have different areas, and have their cathodes coupled together. Equal currents are caused to flow through the diodes. The anode of each diode is coupled to a respective one of the differential inputs of the operational amplifier.

The ratio of the areas of the diodes is selected so that a difference of the junction voltages across the two diodes, as detected by the differential stage of the operational amplifier, will be approximately 55 mV. The output stage of the operational amplifier has a gain of about ten, so that the operational amplifier outputs a voltage of about 0.55 V. This is then added to a bipolar junction voltage of about 0.7 V, to obtain a bandgap voltage of 1.25 V, which is the output of the bandgap circuit.

The circuitry which generates the voltage of 0.55 V has a temperature coefficient which is equal to but opposite to the temperature coefficient of the circuitry which generates the voltage of 0.7 V. Thus, when one of these voltages increases or decreases in response to a temperature change, the other respectively decreases or increases by an equal amount. Consequently, the sum of these voltages, which is the bandgap voltage, remains the same notwithstanding temperature variations.

Due to process variations, the voltage across each of the bipolar diodes may vary from an expected value by 1 mV, even if the diodes are made on the same chip by the same process and are laid out so as to be cross coupled with each other. In a worse-case scenario, where the variations in the two diodes are additive, the offset in the difference voltage of the differential stage will be about 2mV. When this offset is subjected to a gain of ten in the amplifier portion of the operational amplifier, it will produce an offset of 20 mV in the output of the operational amplifier, or in other words, 0.02 V. This 0.02 V offset or error in the output of the operational amplifier is relatively small in comparison to its intended 0.55 V output.

On the other hand, the CMOS transistors of the differential stage are subject to greater variations as a result of the manufacturing process, and in particular may inject at each of the differential inputs a variation or error of 10 mV, even if they are laid out so as to be cross-coupled with each other. In a worse-case scenario where these variations are additive, the offset in the output of the differential stage will be 20 mV. When subjected to the gain of ten in the amplifier portion, the result will be an offset or error of 0.2 V in the output of the operational amplifier. In comparison to the intended output of 0.55 V, this represents a potential error of approximately 36%, which is significant.

A further consideration is that, to the extent such a bandgap circuit uses PNP-type bipolar junction transistors to implement the two diodes, there is no provision to compensate for the split collector current ratio, which leads to undesirable variations of characteristics as a result of process variations. This is due to the fact that the available PNP-type bipolar junction transistors have a very strong substrate effect and weak lateral action, and the split collector current ratio between the substrate and lateral collectors varies significantly with different current densities. This characteristic has been viewed as preventing the design of an accurate bandgap circuit in a CMOS process lacking NPN bipolar junction transistors.

SUMMARY OF THE INVENTION

From the foregoing, it may be appreciate that a need has arisen for a bandgap circuit which is relatively simple in design, which produces an accurate bandgap voltage independent of temperature variations, and which is free of NPN-type bipolar junction transistors so as to facilitate its use in a CMOS process while avoiding the cost and complexity of additional process steps. According to the present invention, an apparatus is provided to address this need, and involves a CMOS-process integrated circuit which contains a bandgap circuit, the bandgap circuit including a differential portion having bipolar first and second components, having an output, and having first and second inputs that are respectively coupled to the first and second components, the bandgap circuit also including a further portion which is responsive to the output of the differential portion, and which has bipolar third and fourth components that are respectively coupled to the first and second inputs of the differential portion, the further portion being operative to generate a bandgap voltage.

BRIEF DESCRIPTION OF THE DRAWINGS

A better understanding of the present invention will be realized from the detailed description which follows, taken in conjunction with the accompanying drawings, in which.

DETAILED DESCRIPTION OF THE INVENTION

Figure 1:
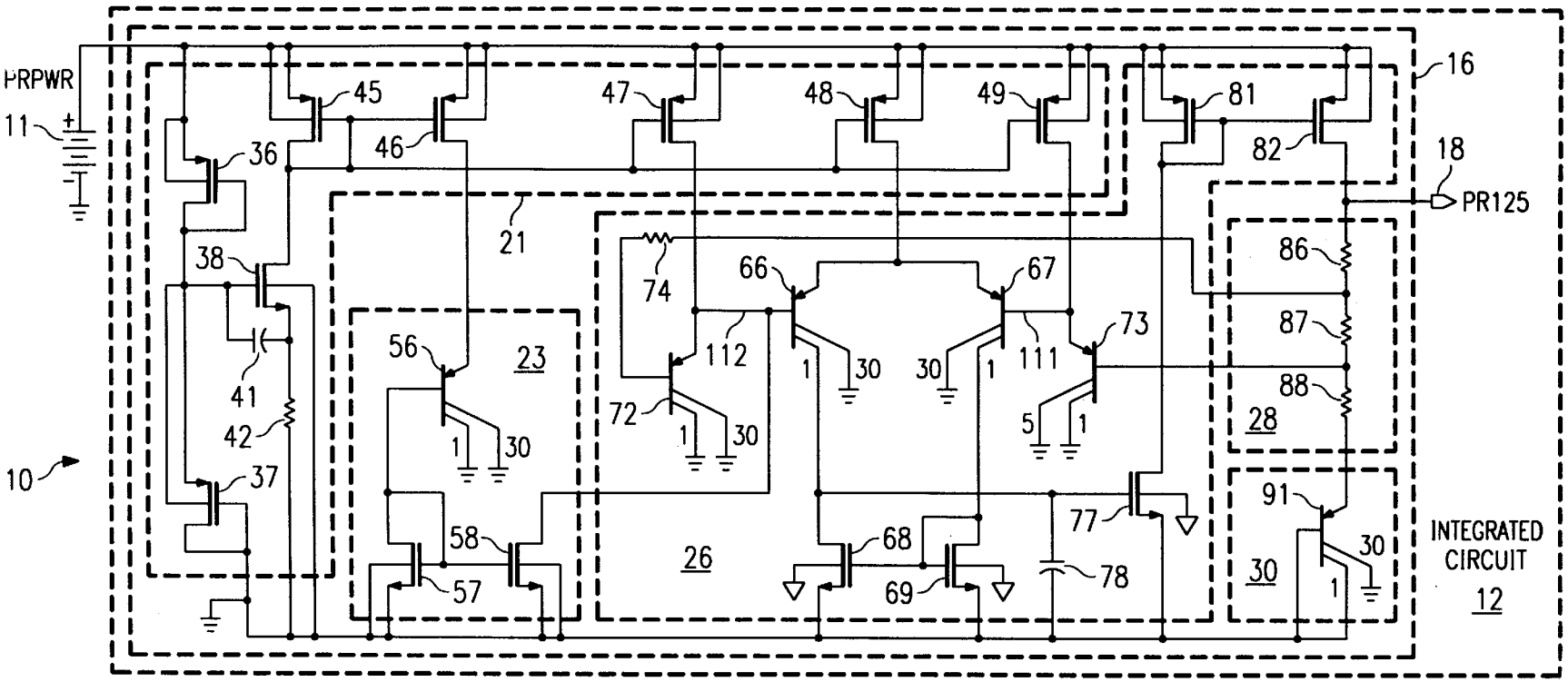
FIG. 1 is a schematic diagram of a circuit which includes an integrated circuit with a bandgap portion that embodies the present invention and generates a bandgap voltage.

FIG. 1 is a schematic diagram of a circuit 10 which embodies the present invention. The circuit 10 includes an integrated circuit 12, and a DC power source 11 which is symbolically depicted as a battery. In the disclosed embodiment, the output PRPWR of the power source 11 during normal operation is 5 VDC.

The integrated circuit 12 includes a bandgap circuit 16 which receives the voltage PRPWR from the power source 11, and which has an output terminal 18 that carries a bandgap voltage PR125. The bandgap voltage is a reference voltage, which in the disclosed embodiment is approximately 1.25 VDC. The actual bandgap voltage may vary slightly from chip to chip, due to manufacturing process variations. The important factor is not the particular bandgap voltage generated by a particular chip, but the fact that the bandgap circuit 16 on any given chip keeps the bandgap voltage substantially constant, notwithstanding variations of temperature or variations of the voltage PRPWR from the power source 11.

In the disclosed embodiment, the bandgap voltage at terminal 18 is supplied to other not-illustrated circuitry within the integrated circuit 12. However, it will be recognized that the bandgap voltage at the output terminal 18 could alternatively be exported off the integrated circuit 12 through an external connection pin, for use externally of the integrated circuit 12. The other circuitry on the integrated circuit 12 might, for example, be a microcontroller suitable for use in an automotive application such as control of an engine or an anti-lock braking system.

The bandgap circuit 16 includes a startup and bias portion 21, a base current compensation portion 23, an amplifier portion 26 which includes a differential stage, a voltage multiplier portion 28, and a diode 30. Each of these parts of the bandgap circuit 16 is described below in more detail.

More specifically, the startup and bias portion 21 includes at 36 a p-channel field effect transistor (FET) having its source and bulk terminals coupled to the supply voltage PRPWR, and having its gate and drain coupled together. A further p-channel FET 37 has its source and bulk terminals coupled to the drain of the transistor 36, and has its gate and drain terminals coupled to ground. Since the transistors 36 and 37 each have their gate and drain terminals coupled together, they each function as a diode. In the disclosed embodiment, the transistors 36 and 37 are identical, and each have a channel length of 30 microns and a channel width of 5 microns.

The startup and the bias portion 21 further includes an n-channel FET 38 which has its gate coupled to the drain of transistor 36, and which has its bulk terminal coupled to ground. The source of the transistor 38 is coupled to one end of a resistor 42, which has its other end coupled to ground. A capacitor 41 has its ends respectively coupled to the gate and the source of transistor 38. Five additional p-channel FETs 45–49 each have their source and bulk terminals coupled to the supply voltage PRPWR, and their gates coupled to the drain of transistor 38. The drain of transistor 45 is also coupled to the drain of transistor 38.

The transistor 45 effectively forms a respective current mirror circuit with each of the transistors 46, 47, 48 and 49. The transistors 46–49 each supply current to a respective portion of the bandgap circuit 16, as described in more detail later.

The transistor 49 in FIG. 1 is actually implemented with eight separate transistors that are coupled entirely in parallel with each other. For convenience, these eight transistors are all represented in FIG. 1 with a single transistor symbol at 49. The eight transistors at 49 are all identical to each other, and are all identical to the transistor 47.

In the disclosed embodiment, the transistors 45–48 each have a channel length of 5 microns, and have respective channel widths of 20 microns, 10 microns, 10 microns, and 160 microns. Each of the eight actual transistors represented symbolically at 49 has a channel length of 5 microns and a channel width of 10 microns. Thus, the current through the transistors 46 and 47 will be about half the current through the transistor 45, and the current through transistor 48 will be about eight times the current through transistor 45. Similarly, the total current through the eight transistors at 49 will be about four times the current through the transistor 45. Further, the total current flow through the transistor 49 will be about eight times the current through the transistor 47, for reasons discussed in more detail later.

The base current compensation portion 23 of the bandgap circuit 16 includes at 56 a PNP bipolar junction transistor (BJT), which has its emitter coupled to the drain of transistor 46, and which has first and second collectors that are both coupled to ground, the split collector ratio between the first and second collectors being 30 to 1. An n-channel FET 57 has its drain and gate coupled to the base of transistor 56, and has its source and bulk terminals coupled to ground. A further n-channel FET 58 has its gate coupled to the gate of transistor 57, and has its source and bulk terminals coupled to ground. Transistors 57 and 58 both have a channel length of 5 microns, transistor 57 has a channel width of 20 microns, and transistor 58 has a channel width of 130 microns. The transistors 57 and 58 define a current mirror circuit, in which the current carried by transistor 58 is approximately 6.5 times the current carried by transistor 57.

The amplifier portion 26 includes two PNP BJTs 66 and 67, which each have an emitter coupled to the drain of transistor 48. Each has a first collector coupled to ground and a second collector coupled to the drain of a respective n-channel FET 68 or 69, the split collector ratio between the first and second collectors being 30 to 1. The gate of transistor of 68 is coupled to the gate and drain of transistor 69, and the source and bulk terminals of transistors 68 and 69 are all coupled to ground. Transistors 68 and 69 together define a current mirror. In the disclosed embodiment, transistors 68 and 69 are identical, and each have a channel length of 5 microns and a channel width of 20 microns. The transistors 66–69 serve as the differential stage of the amplifier portion 26.

The amplifier portion 26 further includes a PNP BJT 72 having an emitter which is coupled to the drain of transistor 47, the base of transistor 66, and the drain of transistor 58. The transistor 72 has first and second collectors which are both coupled to ground, the split collector ratio of the first and second collectors being 30 to 1. The base of transistor 72 is coupled to one end of a resistor 74, the other end of which is coupled to the voltage multiplier portion 28. The amplifier portion 26 also includes a PNP BJT 73, having an emitter which is coupled to the drain of transistor 49 and the base of transistor 67. The transistor 73 has first and second collectors which are both coupled to ground, the split collector ratio of the first and second collectors being 5 to 1. The base of transistor 73 is coupled to the voltage multiplier portion 28. The transistors 72 and 73 serve as an input stage of the amplifier portion 26. The transistors 56, 66–67 and 72–73 all have the same area, which in the disclosed embodiment is one square micron.

The amplifier portion 26 further includes an n-channel FET 77 having its gate coupled to the drain of transistor 68, and having its source and bulk terminals coupled to ground. The signal applied to the gate of transistor 77 is effectively the output of the differential stage that includes transistors 66–69. A capacitor 78 is coupled between ground and the gate of transistor 77, and provides AC coupling to facilitate stable circuit operation.

Two p-channel FETs 81 and 82 each have their source and bulk terminals coupled to the supply voltage PRPWR, and have their gates coupled to the drain of transistor 77. The drain of transistor 77 is also coupled to the drain of transistor 81. The transistors 77, 81 and 82 each have a channel length of 1.5 microns, and have respective channel widths of 25 microns, 5 microns and 25 microns. The transistors 81 and 82 together define a current mirror circuit, and the transistor 82 serves as a current source in a manner described in more detail later. The current through transistor 82 will normally be about five times the current through transistor 81. The transistors 77, 81 and 82 together serve as an amplification stage or output stage of the amplifier portion 26 and, as mentioned above, the transistor 82 functions as a current source.

The voltage multiplier portion 28 includes three resistors 86–88 which are coupled in series between the diode 30 and the drain of transistor 82, the output terminal 18 also being coupled to the drain of transistor 82. The node between the resistors 86 and 87 is coupled to the end of the resistor 74 which is remote from the base of transistor 72, and the node between the resistors 87 and 88 is coupled to the base of transistor 73.

In the disclosed embodiment, the resistor 86 nearest the transistor 82 has a resistance of 45.4 KΩ, the middle resistor 87 has a resistance of 5 KΩ, and the resistor 88 nearest the diode 30 has a resistance of 5.7 KΩ. The combined resistance of the three resistors 86–88 is 56.1 KΩ, and is thus about 11.2 times the resistance of the resistor 87, as discussed in more detail later. As a result, when a current is flowing through the three resistors, the voltage across all three resistors 86–88 will always be approximately 11.2 times the voltage across the resistor 87, and this ratio will be maintained notwithstanding fluctuations in the magnitude of the current. This is why the resistors 86–88 are collectively referred to as a voltage multiplier portion 28, the multiplication factor of which is 11.2.

The diode 30 includes a PNP BJT 91 having an emitter coupled to an end of resistor 88, having a base coupled to ground, and having first and second collectors which are both coupled to ground, the split collector ratio of the first and second collectors being 30 to 1. In the disclosed embodiment, the transistor 91 has an area which is one square micron. The transistor 82, voltage multiplier portion 28, and diode 30 together serve as a voltage generating portion of the circuit 16, which generates the bandgap voltage PR125 at 18.

Figure 2:
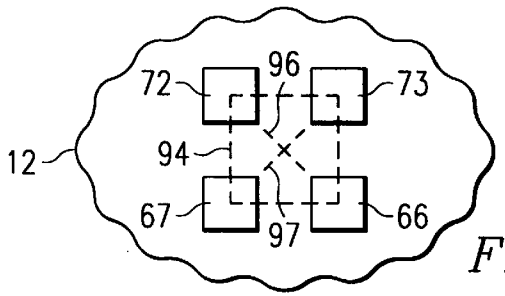
FIG. 2 is a diagrammatic view of a portion of the integrated circuit of FIG. 1, showing a physical layout pattern according to the present invention for four transistors which are components of the bandgap portion of the circuit.

FIG. 2 is a diagrammatic top view of a portion of the integrated circuit 12, showing how the four bipolar junction transistors 66–67 and 72–73 have been laid out. More specifically, these four transistors have been positioned so that each is at a respective corner of an imaginary square, which is shown in broken lines at 94. More specifically, the transistors 72 and 66, which are associated with one side of the differential stage of the amplifier 26, are provided at two opposite corners of the square. Similarly, the transistors 73 and 67, which are associated with the other side of the differential stage, are provided at the other two opposite corners of the square. Viewed in a different way, a first imaginary line 96 that extends between the transistors 66 and 72 intersects a second imaginary line 97 that extends between the transistors 67 and 73.

The bandgap circuit 16 has both n-channel and p-channel FETs, but has only PNP bipolar transistors, in particular at 56, 72, 66, 67, 73 and 91. Consequently, the bandgap circuit 16 of FIG. 1 is particularly suitable for use in an integrated circuit made with a CMOS process, such as a CMOS process with P-epi, where NPN transistors are not available unless extra process steps are implemented. The extra process steps effect an increase in the overall cost of the process which is significant, and the circuit 16 thus avoids this extra cost. The bandgap circuit 16 is simpler and more accurate than known bandgap circuits for a CMOS process in which NPN bipolar transistors are not available.

The operation of the bandgap circuit 16 will now be briefly described. At power on, the DC power source 11 is turned on in order to supply PRPWR (5 VDC) to the integrated circuit 12, including the bandgap circuit 16. As the voltage PRPWR ramps up from 0 VDC to 5 VDC, current will begin to flow through the transistors 36 and 37 which, as mentioned above, function as diodes. The circuit will start to operate when PRPWR reaches about 2 $V_{TH}$ (where $V_{TH}$ is the threshold voltage of PMOS and is about 0.75 volts). Since the transistors/diodes 36 and 37 are identical, the voltage at the node between them, or in other words at the gate of transistor 38, will ramp up so as to be approximately half of the voltage present at PRPWR at any given point in time. Thus, when PRPWR is at 2 $V_{TH}$ the voltage at the base of transistor 38 will be 1 $V_{TH}$ and transistor 38 will start to turn on, as a result of which current will flow through the transistors 45 and 38. When PRPWR is at about 3 Vbe, where Vbe is the voltage across a bipolar base-emitter junction, the transistors 46–49 will be turned on and will provide enough current to start the rest of the bandgap circuit 16. As mentioned above, the transistor 45 effectively forms a respective current mirror circuit with each of the transistors 46–49, and the transistors 46–49 each supply current to a respective node of the bandgap circuit 16.

In this regard, and as mentioned above, the transistor 49 is really eight transistors which are coupled entirely in parallel and which are all identical to each other and to the single transistor at 47. Accordingly, the transistor 49 supplies about eight times as much current to the node 111 as the transistor 47 supplies to the node 112. In the disclosed embodiment, transistors 72 and 73 will be biased with current flows of approximately 10 $\mu$A and 80 $\mu$A, respectively. The precise current magnitudes are less important than maintaining a constant ratio between the currents. This difference in current creates an offset in the differential stage of the amplifier 26, which is the delta Vbe between transistors 72 and 73, and is discussed in more detail later.

Due to the current difference, the node 111 will be at a higher voltage than the node 112, as a result of which the transistor 67 will be turned off and the transistor 66 will be turned on. This in turn turns on transistor 77, so that a current flows through transistors 81 and 77. Since transistors 81 and 82 form a current mirror, current will also flow through the transistor 82, as well as the three resistors 86–88 of the voltage multiplier portion 28, and the diode 30 defined by transistor 91. The current through the resistors 86–88 creates a voltage across resistor 87, which raises the voltage at the base of transistor 72, which in turn raises the voltage at the base of transistor 66, so that transistor 66 begins to turn off. This will then change the voltage at the gate of transistor 77, which changes the current flowing through transistors 81 and 77, which in turn changes the current flowing through transistor 82, resistors 86–88, and diode 30, as the circuit converges toward an equilibrium state.

In the equilibrium state, due to the current mirror defined by transistors 68 and 69, the transistors 66 and 67 of the differential stage will conduct the same amount of current. The current flowing through the transistor 82, the resistors 86–88 and the diode 30 will be such that the voltage across resistor 87 is about 53.6 mV at room temperature (25° C., 300° K.), for reasons discussed in more detail later. The combined resistance of the three resistors 86–88 is 56.1 KΩ, or in other words 11.2 times the resistance of the middle resistor 87, and thus the voltage across the three resistors 86–88 will be 11.2 times the voltage across the resistor 87. In particular, when is the resistor has across it the equilibrium voltage of 53.6 mV (at room temperature), the voltage across the three resistors 86–88 will be approximately 0.6 V. The junction voltage Vbe of the transistor 91 in the disclosed embodiment will be about 0.65 V at room temperature. Thus, the sum of the voltages across the voltage multiplier portion 28 and the diode 30 will be 1.25 V at room temperature, such that the desired bandgap voltage of 1.25 V will be present at the output terminal 18.

The ambient temperature may, of course, vary from room temperature. In this regard, the portions of the bandgap circuit 16 which determine the voltage across the voltage multiplier portion 28 have a temperature coefficient which will cause the voltage across voltage multiplier portion 28 to increase or decrease. For reasons explained later, this temperature coefficient is equal and opposite to the temperature coefficient of the transistor 91 that defines diode 30.

Consequently, if a temperature change causes the junction voltage Vbe of the transistor 91 to increase by a certain amount, the voltage across voltage multiplier portion 28 will decrease by the same amount, so that the sum of these voltages is the same, and thus the bandgap voltage produced at output terminal 18 will remain at 1.25 V. Conversely, if a temperature change causes the junction voltage Vbe of transistor 91 to decrease by a certain amount, the voltage across voltage multiplier portion 28 will increase by the same amount, so that the sum of these voltages still does not change, and the bandgap voltage at output terminal 18 will remain at 1.25 V.

As mentioned above, manufacturing process variations for any given integrated circuit may cause the bandgap voltage produced at the output terminal 18 to have a value which is slightly different from the desired value of 1.25 V. However, whatever the particular bandgap voltage produced at 18 by a given bandgap circuit 16, the bandgap circuit 16 will accurately maintain that particular bandgap voltage notwithstanding temperature variations, which is the intended purpose of the bandgap circuit 16.

As discussed above, transistor 49 sources eight times as much current as the transistor 47. The transistors 72 and 73 have identical base resistances. Since more current is flowing through the base resistance of transistor 73 than through the base resistance of transistor 72, the resistor 74 is provided in series with the base of transistor 72, in order to produce an extra voltage drop in a manner so that the combined voltage drop across the resistor 74 and the base resistance of transistor 72 is effectively equal to the voltage drop across the base resistance of the transistor 73.

As explained above, the transistors 66 and 67 have the same amount of current flowing through them at equilibrium, and thus the base currents flowing out their bases are equal. In contrast, and as also explained above, the current flowing through transistor 73 is eight times the current flowing through transistor 72. In order to maintain this ratio, approximately ⅞ of the current flowing out of the base of transistor 66 should theoretically be drawn off by the base current compensation circuit 23, so that only about ⅛ of the current from the base of transistor 66 flows through the transistor 72. However, actually drawing off precisely ⅞ of the current from the base of transistor 66 could introduce instability such as oscillation into the bandgap circuit. To avoid this, the base current compensation circuit 23 is designed to draw off about 6.⅝ of the base current flowing out of transistor 66.

More specifically, a current flows through transistors 46 and 56, and the base current from transistor 56 flows through transistor 57. Transistors 57 and 58 define a current mirror, as discussed above, and thus the current flowing through transistor 57 sets up a current flow through transistor 58. The base current compensation circuit 23 is designed so that the current flow through transistor 58 is approximately 6.⅝ of the base current out of transistor 66 when the bandgap circuit 16 is in equilibrium at room temperature.

With reference to FIG. 2, and given the fact that the four transistors 66–67 and 72–73 are all bipolar, the physical layout pattern for these four transistors effects cross-coupling or matching of the transistor pair 66 and 72 associated with one side of the differential stage relative to the transistor pair 67 and 73 associated with the other side of the differential stage. This minimizes the voltage offset which may exist between the two sides of the differential stage as a result of manufacturing process variations.

The voltage which will be present across the resistor 87 at equilibrium may be derived mathematically, as explained below. More specifically, pursuant to Kirchhoff's law, the voltages around a circuit loop must total zero. With this in mind, the following discussion focuses on the loop which includes the resistors 87 and 74, and the base-emitter junctions of transistors 72, 66, 67 and 73. For purposes of this analysis, the voltage drop across resistor 74 is negligible, and is ignored. Working around the loop, the sum of the voltages is $$V_R-[(Vbe_{73}+Vbe_{67})-(Vbe_{72}+Vbe_{66})]=0 \quad (1)$$

where $V_R$ is the voltage across the resistor 87, and each Vbe is a base-emitter junction voltage for a respective one of the transistors 66, 67, 72 and 73. Since the transistors 72 and 73 have equal amounts of current passing through them, they will have equal base-emitter junction voltages Vbe, and these two terms in equation (1) will therefore cancel out, leaving $$V_R=Vbe_{73}-Vbe_{72} \quad (2)$$

It is known for a bipolar device that the base-emitter junction voltage Vbe may be expressed as:

$$Vbe = V_T\ln\left(\frac{I}{Is}\right) \quad (3)$$

where $V_T$ is 25.8 mV at room temperature (25° C. or 300° K.), I is a collector current, and $I_s$ is a saturation current. Substituting Equation (3) into Equation (2) yields $$V_R = V_T\ln\left(\frac{I_{73}}{Is_{73}}\right) - V_T\ln\left(\frac{I_{72}}{Is_{72}}\right) \quad (4)$$

-continued $$= V_T\left[\ln\left(\frac{I_{73}}{Is_{73}}\right) - \ln\left(\frac{I_{72}}{Is_{72}}\right)\right]$$

$$= V_T \ln\left(\frac{I_{73} Is_{72}}{I_{72} Is_{73}}\right)$$

The saturation current $I_s$ is dependent on the area of the device. As discussed above, the transistors 66 and 67 are effectively identical and have the same area, and they thus have the same saturation current $I_s$. The value of $I_s$ for each will vary with temperature, but the variation will be the same for each of them. Thus, the saturation currents $Is_{66}$ and $Is_{67}$ cancel each other out in Equation (4).

In addition, and as discussed above, the transistors 49 and 47 are designed so that the current flowing through the transistor 73 will be eight times the current flowing through transistor 72. Consequently, the ratio of currents shown in Equation (4) is eight. This current ratio has been selected because Equation (4) involves the natural logarithm of this ratio, and the natural logarithm of eight appears at a point on the slope of the logarithm curve which is considered advantageous. However, the invention is not limited to this particular ratio, and other ratios could be used. In any event, given a current ratio of eight, and since $V_T$ is known to be 25.8 mV at room temperature, the voltage $V_R$ across resistor 87 at room temperature can be determined from Equation (4) as follows:

$$V_R = V_T \ln(8) = 25.8 \text{ mV } (2.0775) = 53.6 \text{ mV} \tag{5}$$

As discussed above, the bandgap voltage at the output terminal 18 remains accurate notwithstanding temperature variations, due to the fact that the voltage across the voltage multiplier portion 28 and the voltage across the diode 30 have temperature coefficients which are equal and opposite. The manner in which this has been achieved may be explained mathematically as follows. First, a determination is made of the variation which the voltage across the resistor 87 will exhibit with respect to each degree of temperature change, as follows:

$$\left.\frac{dV_R}{dT}\right|_{300°K} = \frac{53.6\text{mV}}{300°\text{K}} \approx 0.18\text{mV}/°\text{K} \tag{6}$$

In other words, the voltage VR across the resistor 87 will vary by approximately 0.18 mV per Kelvin degree. It is known that the base-emitter junction voltage Vbe of the transistor 91 will vary by about 2 mV per Kelvin degree. Thus, in order that the sum of the voltages across the voltage multiplier portion 28 and the diode 30 will be constant, and since the rate of variation of the voltage Vbe across the diode 30 is 2 mV/° K., the voltage across the voltage multiplier portion 28, or in other words the voltage across all three resistors 86–88, must vary inversely by the same amount, or in other words by 2 mV/° K. With reference to Equation (6), this means that when the voltage across resistor 87 varies by 0.18 mV/° K., the voltage across all three resistors 86–88 must vary by 2 mV/° K. Consequently, the ratio of resistances must be:

$$\frac{R_{86} + R_{87} + R_{88}}{R_{87}} = \frac{2\text{mV}/°\text{K}}{0.18\text{mV}/°\text{K}} = 11.2 \tag{7}$$

For this reason, the resistors 86–88 have been chosen to have a combined resistance of 56.1 KΩ and the resistor 87 has been chosen to have a resistance of 5 KΩ, because 56.⅕ is 11.2.

A further refinement is that the 45.4 KΩ resistance of resistor 86 is approximately eight times the 5.7 KΩ resistance of the resistor 88, in order to effect beta compensation by canceling out the effect of the base currents of transistor 72 and 73.

If the transistors 66 and 67 of the differential stage were CMOS transistors rather than bipolar transistors, and even assuming they were laid out so as to be cross-coupled with each other, the maximum voltage offset introduced into the difference voltage in the differential stage could be 10 mV, which is significant in comparison to the difference voltage generated in the differential stage. However, since the transistors 66 and 67 are bipolar according to the present invention, the maximum voltage offset in the difference voltage is about one-tenth the offset associated with CMOS transistors. When all four of the transistors 66–67 and 72–73 are laid out as shown in FIG. 2, the cross-coupling between them further reduces the maximum voltage offset due to transistors 66 and 67 to about 1 mV, which is nominal in comparison to the magnitude of the difference voltage generated in the differential stage.

The present invention provides numerous technical advantages. One such technical advantage is the provision, in a CMOS process such as a CMOS P-epi process, of a bandgap circuit which is simpler and more accurate than known bandgap circuits for a CMOS process. A further advantage is that a differential stage within the bandgap circuit uses bipolar PNP transistors rather than CMOS transistors, which has the effect of reducing the input offset by a factor of about ten. Four transistors are cross-coupled in a manner which has the advantage of further reducing the input offset.

Yet another advantage is that the design of the bandgap circuit renders it independent of the split collector ratio of the PNP transistors. Two PNP transistors, which generate a difference between base-emitter voltages, are operated in a common collector mode, to nullify the effect of the difference in the split collector current ratio caused by different current densities.

Although one embodiment has been illustrated and described in detail, it should be understood that various changes, substitutions and alterations can be made therein without departing from the scope of the present invention. For example, the disclosed embodiment utilizes a current ratio of 8 to 1 between two transistors, and in this regard implements one of these transistors with eight separate transistors which are connected in parallel. However, a different current ratio could be used, and could be achieved by a technique other than providing several identical transistors which are coupled in parallel. As another example, a particular layout pattern is disclosed for four transistors, in order to facilitate a cross-coupling effect, but it will be recognized that there are other ways to lay out these transistors without departing from the scope of the present invention. As still another example, the bandgap circuit is disclosed in the specific context of a CMOS P-epi process, but the bandgap circuit can alternatively be implemented with discrete components or in an integrated circuit fabricated by some other process.

It should also be recognized that direct connections disclosed herein could be altered, such that two disclosed components or elements are coupled to one another through an intermediate device or devices without being directly connected, while still realizing the present invention. Other changes, substitutions, and alterations are also possible without departing from the spirit and scope of the present invention, as defined by the following claims.

What is claimed is:

1. An apparatus comprising a CMOS-process integrated circuit which includes a bandgap circuit, said bandgap circuit including:

a differential portion devoid of NPN-type bipolar components and having bipolar first and second components, having an output, and having first and second inputs that are respectively coupled to said first and second components, said differential portion further having bipolar third and fourth components that are respectively coupled to said first and second inputs of said differential portion, said third and fourth components being operatively coupled to said first and second components to generate a differential voltage, said differential portion further having a current source that is responsive to said output;

a bias portion devoid of NPN-type bipolar components and being operative to bias the differential portion;

a base current compensation portion devoid of NPN-type bipolar components and configured to sink base current flowing out of the first bipolar component when the bandgap circuit is in an equilibrium state;

a voltage multiplier portion devoid of NPN-type bipolar components and operatively responsive to the differential voltage to generate a bandgap voltage; and a diode portion devoid of NPN-type bipolar components and operatively coupled to the voltage multiplier portion, wherein the current source is operative to cause a current to flow through said voltage multiplier portion and said diode portion and thereby control the bandgap voltage.

2. An apparatus according to claim 1, wherein said first and second components respectively include first and second transistors which are bipolar junction transistors with substantially identical characteristics, said first and second transistors having emitters which are coupled to each other and to a power source, and having bases which respectively serve as said first and second inputs.

3. An apparatus according to claim 1, wherein said first and second components include respective bipolar junction transistors which each have a collector coupled to a respective node of a mirror circuit.

4. An apparatus according to claim 1, wherein said first, second, third and fourth components each include a PNP bipolar junction transistor.

5. An apparatus according to claim 1, wherein said first, second, third and fourth components respectively include first, second, third and fourth transistors which are bipolar junction transistors, said third and fourth transistors having emitters which are respectively coupled to bases of said first and second transistors; and further wherein the bias portion includes a first transistor which is coupled between a source of power and said emitter of said third transistor and which has a control terminal provided with a biasing signal; and further includes a second transistor which is coupled between a source of power and said emitter of said fourth transistor and which has a control terminal coupled to the control terminal of said first transistor, said second transistor having approximately eight times as much current flowing therethrough as said first transistor.

6. An apparatus comprising a CMOS-process integrated circuit which includes a bandgap circuit, said bandgap circuit including:

a differential portion devoid of NPN-type bipolar devices and having an output and having first and second transistors which are bipolar junction transistors, said first and second transistors having emitters which are coupled to each other and to a source of power, said differential portion further including a current mirror circuit having two transistors which are each coupled between ground and a collector of a respective one of said first and second transistors and third and fourth transistors which are bipolar junction transistors, which each have an emitter coupled to a source of power and to a base of a respective one of said first and second transistors, and which each have a collector coupled to ground and a further portion having a resistance coupled in series with a bipolar junction device between ground and a bandgap voltage output terminal, said resistance including a plurality of resistors coupled in series with each other, one of said resistors having ends which are respectively coupled to a base of said third transistor and a base of said fourth transistor; and a current source devoid of NPN-type bipolar devices and which is responsive to said output of said differential portion and which is operative to cause a current to flow through said resistance and said bipolar junction device, said current having a magnitude which corresponds to a magnitude of a signal at said output of said differential portion.

7. An apparatus according to claim 6, wherein said first, second, third and fourth transistors are laid out in said integrated circuit so that an imaginary line extending between said first and third transistors intersects an imaginary line extending between said second and fourth transistors.

8. An apparatus according to claim 6, wherein said plurality of resistors includes first, second and third resistors, said first resistor having a first end coupled to said output terminal and a second end coupled to said base of said third transistor, said second resistor having a first end coupled to said second end of is said first resistor and having a second end coupled to said base of said fourth transistor, and said third resistor having a first end coupled to said second end of said second resistor and having a second end coupled to said bipolar junction device;

wherein said fourth transistor has a current flowing therethrough which is approximately eight times a current flowing through said third transistor; and wherein a resistance of said first resistor is approximately nine times a resistance of said second resistor and approximately eight times a resistance of said third resistor.

9. An apparatus according to claim 8, including a further resistor coupled between said base of said third transistor and said second end of said first resistor, and including a base current compensation circuit coupled to said base of said first transistor and operative to draw off approximately ⅞ of a base current flowing out of said first transistor.

10. An apparatus comprising an integrated circuit which includes a bandgap circuit, said bandgap circuit including:

a differential portion devoid of NPN-type bipolar devices and having an output, having bipolar first and second components, and having first and second inputs that are respectively coupled to said first and second components the differential portion further having bipolar third and fourth components that are respectively coupled to said first and second inputs of said differential portion, said third and fourth components being operative to generate a differential voltage;

said first, second, third and fourth components being laid out in said integrated circuit so that an imaginary line extending between said first and third components intersects an imaginary line extending between said second and fourth components;

a voltage multiplier portion devoid of NPN-type bipolar components and operatively responsive to the differential voltage to generate a bandgap voltage;

a diode portion devoid of NPN-type bipolar components and operatively coupled to the voltage multiplier portion; and a current source devoid of NPN-type bipolar components and responsive to said output of said differential portion to cause a current to flow through said voltage multiplier portion and said diode portion and thereby control the bandgap voltage.

11. An apparatus according to claim 10, wherein said first, second, third and fourth components are of substantially identical size.

12. An apparatus according to claim 10, wherein said first, second, third and fourth components are each located approximately at a respective corner of an imaginary square.

13. An apparatus according to claims 10, wherein each of said first, second, third and fourth components is a PNP bipolar junction transistor.

14. An apparatus according to claim 10 further including a bias portion devoid of NPN-type bipolar components and being operative to bias the differential portion.

15. An apparatus according to claim 10 further including a base current compensation portion devoid of NPN-type bipolar components and configured to sink base current flowing out of a differential portion bipolar component when the bandgap circuit is in an equilibrium state.

* * * * *